US005165848A

United States Patent [19]

Plemmons

[11] Patent Number: 5,165,848

[45] Date of Patent: Nov. 24, 1992

[54] VANE LINER WITH AXIALLY POSITIONED HEAT SHIELDS

[75] Inventor: Larry W. Plemmons, Fairfield, Ohio

[73] Assignee: General Electric Company, Cincinnati, Ohio

[21] Appl. No.: 727,182

[22] Filed: Jul. 9, 1991

[51] Int. Cl.[5] ..... F01D 25/08

[52] U.S. Cl. ..... 415/177; 415/174.5; 29/888.01; 29/888.3; 29/525.1

[58] Field of Search ..... 415/177, 178, 170.1, 415/173.1, 173.3, 174.2, 174.4, 173.4; 29/888.01, 888.3, 525.1

[56] References Cited

U.S. PATENT DOCUMENTS

| | | | |
|---|---|---|---|
| 3,042,365 | 7/1962 | Curtis et al. | 415/173.4 |
| 3,365,172 | 1/1968 | McDonough et al. | 415/173.4 |
| 3,423,070 | 1/1969 | Corrigan | 415/173.4 |
| 3,656,862 | 4/1972 | Rahaim et al. . | |
| 3,728,041 | 4/1973 | Bertelson . | |
| 3,970,319 | 7/1976 | Carroll et al. | 415/173.4 |
| 4,087,199 | 5/1978 | Hemsworth et al. . | |
| 4,101,242 | 7/1978 | Coplin et al. . | |
| 4,309,145 | 1/1982 | Viola . | |
| 4,398,866 | 8/1983 | Hartel et al. . | |
| 4,405,284 | 9/1983 | Albrecht et al. . | |
| 4,525,998 | 7/1985 | Schwarz . | |
| 4,565,492 | 1/1986 | Bart et al. . | |
| 4,826,397 | 5/1989 | Shook et al. . | |

*Primary Examiner*—Edward K. Look
*Assistant Examiner*—Christopher M. Verdier
*Attorney, Agent, or Firm*—Jerome C. Squillaro; John R. Rafter

[57] ABSTRACT

A heat shield device for a vane liner in which a first plurality of honeycomb cells which are axially aligned are attached to a first side of the vane liner. A second plurality of honeycomb cells are axially aligned and attached to a second side of the vane liner. The first and second sides of the vane liner are opposite to each other and are provided with cavities which are filled in by the first and second pluralities of honeycomb cells.

11 Claims, 4 Drawing Sheets

VANE LINER WITH AXIALLY POSITIONED HEAT SHIELDS

CROSS-REFERENCE

This case is related to co-pending U.S. patent application Ser. Nos. 07/727,189; 07/727,268/ 07/727,178; and 07/727,186 filed concurrently herewith.

BACKGROUND OF THE INVENTION

The present invention pertains to heat shields for gas turbine engines and, more particularly, to a method and apparatus for inhibiting air leakage between adjacent flow path liners, such as vane liners, at the radially outer ends of stationary compressor vanes.

In prior art gas turbine engines, flow path liners, such as the vane liners in the compressor stage of the engine, are typically secured to the outer casing by hooks which are slidably connected to the casing wall. Such a connection results in a leak path which allows hot gases to flow between the casing and vane liner. The smooth sides of the vane liner and casing provide an unimpeded flow path in which the velocity of hot gases is undiminished with resulting convection heat transfer to the casing and vane liner. Those skilled in the art realize that heat can be transferred by convection and conduction with a particular convective heat transfer coefficient being determined by the hot gases and the medium over which the hot gases flow. The greater the velocity of the gases over the medium, the greater the heat transfer. Such undesired heat transfer can cause thermal damage and distortion to the casing and reduce performance.

Thus, a need exists for a mechanism for impeding the velocity of gases which flow in the leakage paths provided by the gaps formed between the casing and sides of a vane liner.

SUMMARY OF THE INVENTION

Accordingly, one object of the present invention is to provide a novel vane liner which is provided with axially aligned honeycomb cells in slots positioned at opposite sides of the vane liner for purposes of preventing thermal damage and distortion to the casing by reducing air velocity in the radial and tangential directions.

Yet another object of the present invention is to combine the heat shielding properties of the vane liner of the present invention with radially aligned honeycomb cells which protect the casing positioned radially outward from the vane liner from thermal damage.

Another object of the present invention is to reduce creep of casing flanges by achieving a reduction in casing temperature also resulting in tighter blade-tip clearance for improved performance.

Yet another object of the present invention is to reduce circumferential temperature gradients in the casing to prevent blade tip rubs thereby improving performance.

Yet another object of the present invention is to reduce flow velocity between adjacent flow path liner segments.

Still another object of the present invention is to reduce parasitic leakage from the compressor flow path by means of the axially aligned honeycomb cells contained in circumferentially positioned vane line liners.

These and other valuable objects and advantages of the present invention are accomplished by a heat shield device for a flow path liner, such as a vane liner in a gas turbine engine compressor. The device has a first plurality of honeycomb cells which is axially aligned and attached to a first side of the vane liner. A second plurality of honeycomb cells is axially aligned and attached to a second side of the vane liner. The first and second sides of the vane liner are positioned opposite each other.

The vane liners of the present invention are positioned radially outward of vanes located in a gas turbine engine, such as those vanes located in the compressor stage of the engine. Thus, the vanes are located circumferentially at various locations with each vane liner having a first plurality of honeycomb cells which is axially aligned and attached to a first side of the vane liner and a second plurality of honeycomb cells axially aligned and attached to a second side of the vane liner. The first plurality of honeycomb cells fills a first slot in the first side of the vane liner and the second plurality of honeycomb cells fills a second slot in a second side of the vane liner.

Above each vane liner of the present invention is located a third plurality of honeycomb cells radially aligned and biased against a casing. The radially and axially aligned honeycomb cells protect the casing from distortion and damage such as damage caused by creep and thermal distortion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it should be understood that like reference numerals designate identical or corresponding parts throughout the several views.

DETAILED DESCRIPTION OF THE INVENTION

Figure 1:
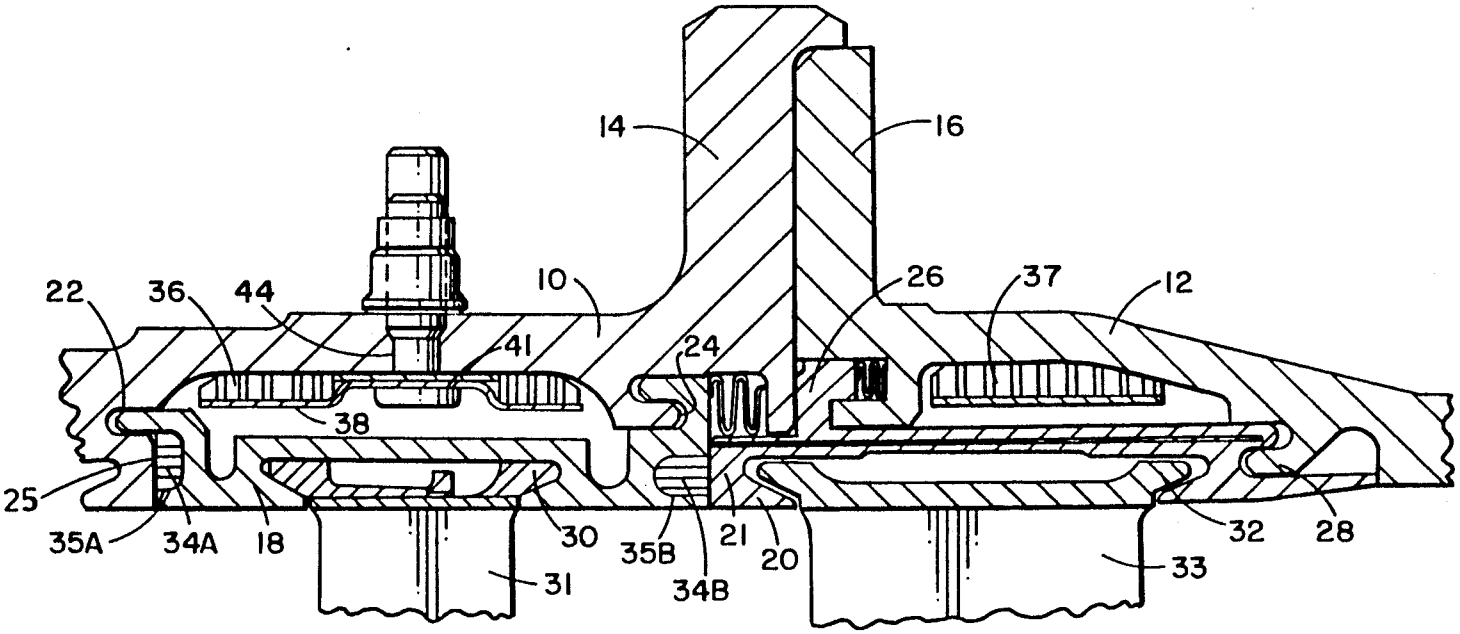
FIG. 1 is a schematic cross-sectional illustration of a vane liner according to the present invention and interconnected components.

With reference to FIG. 1, a compressor case 10 integrally connected to a compressor case flange 14 is connected to a compressor rear frame case 12 by the connection afforded by the compressor rear case flange 16 which is bolted (bolts not shown) to compressor case flange 14. The compressor rear frame case 12, depicted in FIG. 1, extends 360° so as to enclose a plurality of OGV's (outlet guide vanes) 33. Below compressor case 10 is a plurality of radially aligned honeycomb cells 36. The honeycomb cells 36 are attached to a support plate 38 which has a dome section 41 which is fastened to the case 10 by means of bolt 44. Below the radially aligned honeycomb cells is located vane liner 18.

Vane liner 18 is provided with a finger 22 integrally attached to the vane liner for purposes of connecting the vane liner 18 with the compressor case 10 at one side of the vane liner. Vane liner 18 is further provided with a slot 24 for connectably fitting the vane liner 18 with the case 10 at the opposite side of the vane liner 18. Vane liner 18 is formed to accommodate the dovetail 30 of each vane 31. A plurality of axially aligned honeycomb cells 34A fills a slot 35A on one side of the vane liner 18. In a like manner, a plurality of axially aligned honeycomb cells 34B are positioned in a slot 35B located on an opposite side of vane liner 18.

The axially aligned honeycomb cells 34A, 34B are brazed or otherwise attached to the vane liner 18, with each honeycomb cell 34A having an open end substantially flush with the end surface 25 of compressor case 10. In actuality the honeycomb 34A, 34B is open at both ends when it is brazed into slots 35A, 35B; however, some cells may be closed at one end by the brazing. Each honeycomb cell 34B has an open end which is substantially flush with end surface 21 of liner 20, this open end being exposed to high velocity gases.

Still referring to FIG. 1, a second plurality of radially aligned honeycomb cells 37 are positioned below and connected to compressor rear frame case 12 by means of springs (shown in FIG. 4 and indicated by 48). An OGV (outlet guide vane) liner 20 is positioned below case 12 and connected thereto by means of a hook 26 connected integrally with the liner and a hook 28 which are formed to accommodate a fit between the liner 20 and the case 12. Also, liner 20 is formed to accommodate the dovetail 32 of each OGV 33. The axially aligned honeycomb cells 34B are positioned in close proximity to end surface (lateral side) 21 of liner 20.

Figure 2B:
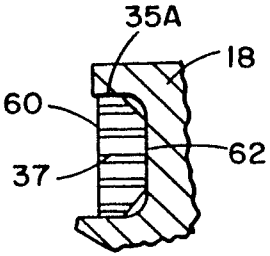
FIG. 2B is a schematic illustration depicting how the honeycomb cells are positioned in the cavities at opposite sides of the vane liner of the present invention.
Figure 2A:
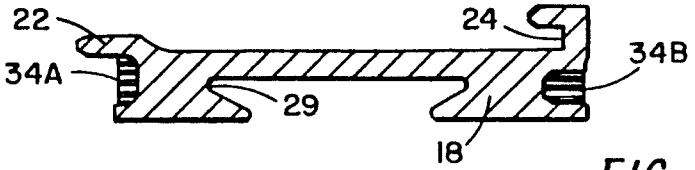
FIG. 2A is a close-up schematic cross-sectional illustration of the vane liner according to the present invention.

FIG. 2A clearly demonstrates the finger 22 and slot 24 located at opposite sides of the vane liner 18 and the dovetail section 29 located therebetween. Section 29 is for purposes of accommodating and securing the dovetail 30 of each vane 31. The plurality of axially aligned honeycomb cells 34A and 4B, which are positioned on opposite sides of the vane liner 18, are secured into slots 35A and 35B, respectively. Slot 35A is shown in FIG. 1 with the plurality of axially aligned honeycomb cells 34A being secured and brazed to the vane liner 18. Each of the honeycomb cells 34A has an open end 60 which is opposite to an end 62 which is located inside slot 35A of the vane liner 18. Honeycomb cells 34B are arranged in a similar manner with the open end of the cells 34B extending in an opposite direction to that of open end 60.

Figure 2C:
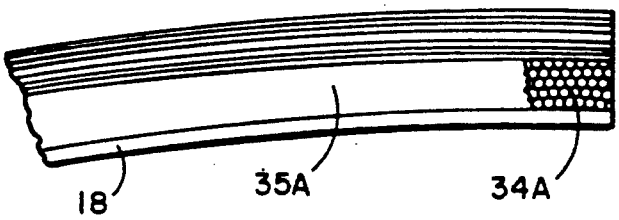
FIG. 2C is an axial view of the axially aligned honeycombs positioned in a slot of a vane liner according to the present invention.

In FIG. 2C, an axial view of the vane liner 18 shows slot 35A filled with honeycomb cells 34. A plurality of vane liners such as vane liner 18 form two circumferential slots (the aggregate of slots 35A and 35B) which are filled with honeycomb cells. The open ends 60 of the honeycomb cells 34A, 34B cause turbulence and resistance to flow velocity in the gas flowing between the gaps existing between vane liner 18 and case 10 and between vane liner 18 and liner 20 thereby reducing convective heat transfer to the vane liners and conduction heat transfer from the vane liners to the case. Compressed air tends to enter the gaps between liner 18 and casin9 10 (and between liner 18 and liner 20). The compressed air has radial and tangential velocity components due to rotor rotation. The open cells in the axial aligned honeycomb are perpendicular to this flow and reduce the flow velocity. In addition, the honeycomb 34A and 34B reduce the effective conduction area of the vane liners thereby reducing the conduction heat transfer through the vane liners to the case 10.

Figure 3:
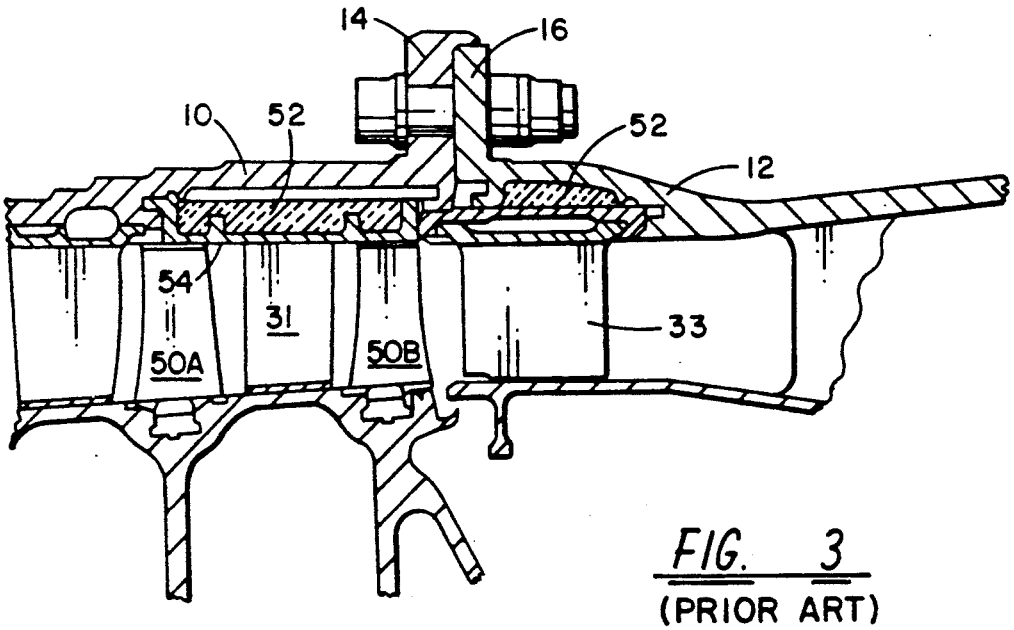
FIG. 3 (PRIOR ART)
FIG. 3 is a schematic illustration depicting the spatial relationship of the rotor blades, vanes, vane liners, and insulation blanket of a prior art turbine engine.

The schematic illustration of FIG. 3, provides the reader with a historical perspective of a prior art compressor in which case 10 was insulated by means of insulation blankets 52 which were positioned above the vane liner 54. Vanes 31, located below vane liner 54, are positioned between rotating blade rows 50A and 50B. Located to the aft of blade row 50B are stationary OGV's 33 which are positioned radially inward from liner 20 which is attached to the compressor rear frame case 12.

Figure 4:
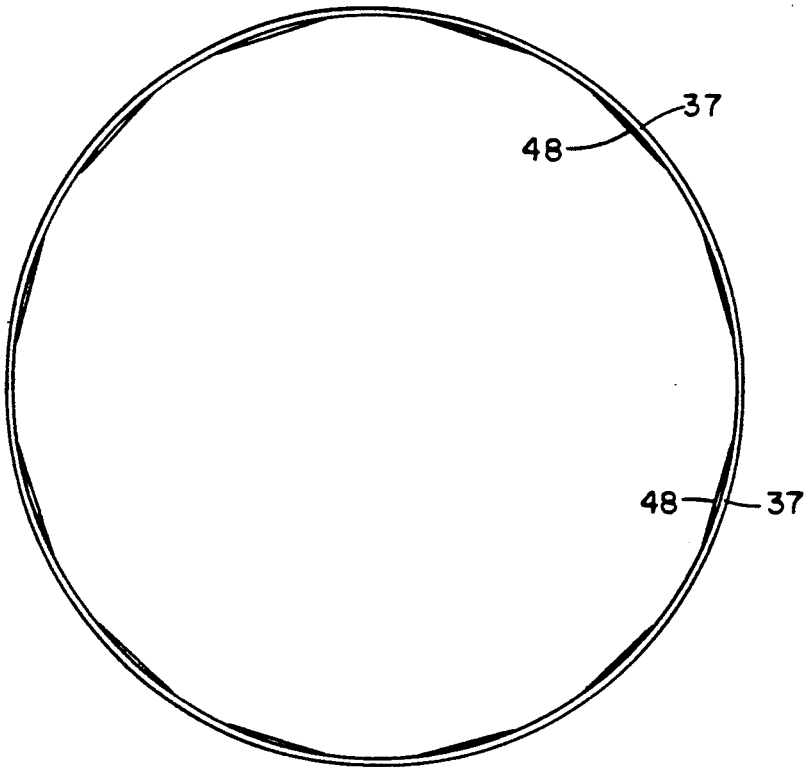
FIG. 4 is a frontal view of the circumferentially positioned radial honeycomb cells which are biased against the rear frame case (rear frame case not shown in FIG. 4)

FIG. 4 demonstrates how a plurality of springs 48 is located at various circumferential positions around case 12 (case 12 not being shown in FIG. 4). Springs 48 are supported by liner 20 (not shown in FIG. 4) and exert a force on honeycombs 37 so that at least one of the honeycombs 37 connected to each liner 20 is in contact with casing 12.

The compressor case 10 (see FIG. 1) is a split case extending 180°. The radially aligned plurality of honeycomb cells 36 depicted in FIG. 1 corresponds, to a twelve o'clock position depicted by section 6B—6B of FIG. 5. The plurality of radially aligned honeycomb cells 36 is connected to the casing 10 at the twelve and six o'clock positions by means of bolts 44 (see FIG. 1). The bolt 44 connects the dome area 41 of support plate 38 to the casing 10, shown in FIG. 1, to aid in the assembly of the liners. Support plate 38 is brazed to the plurality of radially aligned honeycomb cells 36. However, instead of being bolted, elsewhere along the 180° length of case 10, the radially aligned honeycomb cells 36 are secured to the case 10 by means of springs 46.

Figure 5:
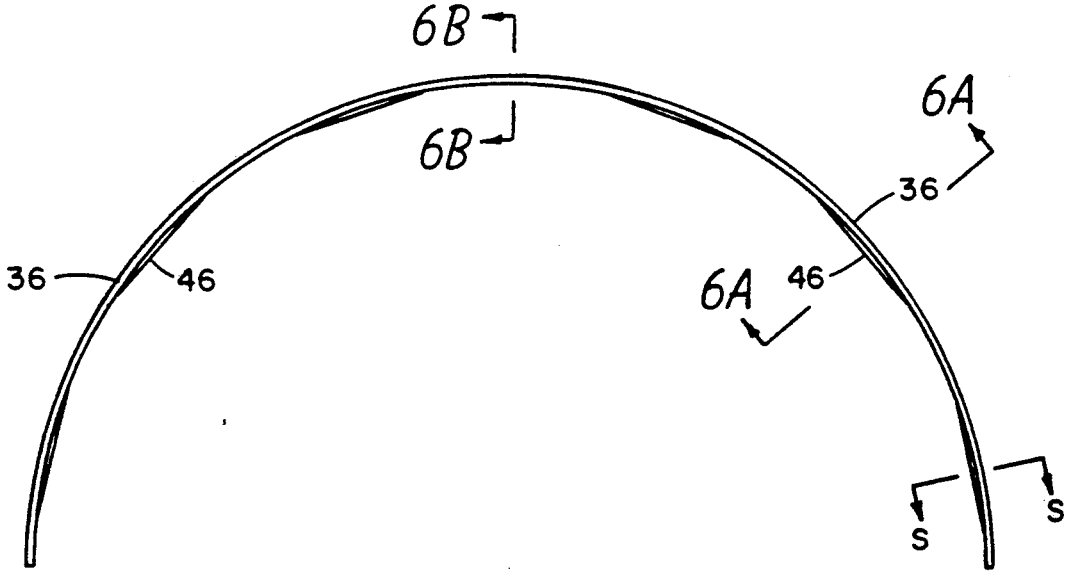
FIG. 5 is a frontal schematic illustration of a 180° honeycomb assembly which is located radially outward of the vane liners of the present invention, springs are depicted to illustrate how the radially aligned honeycomb cells are positioned at different circumferential locations on the case (not shown in FIG. 5) and biased by means of the springs.

FIG. 5 shows a 180° continuous segment of aligned honeycomb cells 36. The springs 46 bias the radially aligned honeycomb cells 36 against the casing 10 due to the force generated by the springs 46 that react against each vane liner 18. Thus, springs 46 are placed in compression at assembly as a result of their position between the support plate 38 connected to the radially aligned plurality of honeycomb cells and each vane liner 18. Springs 46 act against liner 18 to urge the open cells of the honeycomb into engagement with case 10.

Figure 6A:
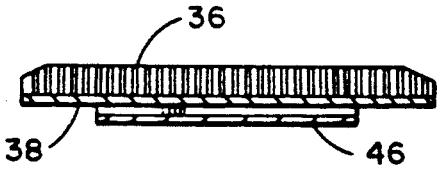
FIG. 6A is a cross-sectional illustration taken along line 6A—6A of FIG. 5.
Figure 6B:
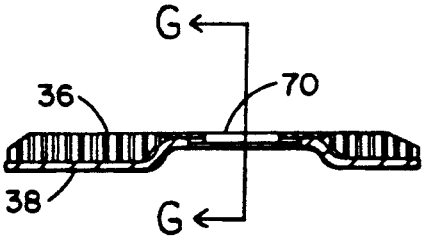
FIG. 6B is a cross-sectional illustration taken along 6B—6B of FIG. 5.
Figure 6C:
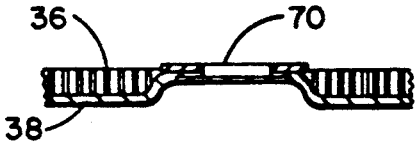
FIG. 6C is a cross-sectional illustration taken along line G—G of FIG. 6B.

FIGS. 6A and 6B are cross-sectional illustrations broken along lines 6A—6A and 6B—6B, respectively, in FIG. 5. FIG. 6A illustrates the radially aligned honeycomb cells 36 connected to support plate 38 which is connected to spring 46 as by tack welding or brazing one end of the spring to plate 38. In FIG. 6B, the radially aligned honeycomb cells 36 are those of FIG. which correspond to the twelve o'clock position represented by section 6B—6B of FIG. 5. FIG. 6B demonstrates the aperture 70 in the dome 41 of support plate 38 which allows bolt 44 (FIG. 1) to position the cells 36 with respect to casing 10 (FIG. 1). FIG. 6C is a cross-section of radially aligned honeycomb cells taken along section G—G of FIG. 6B.

Figure 7:
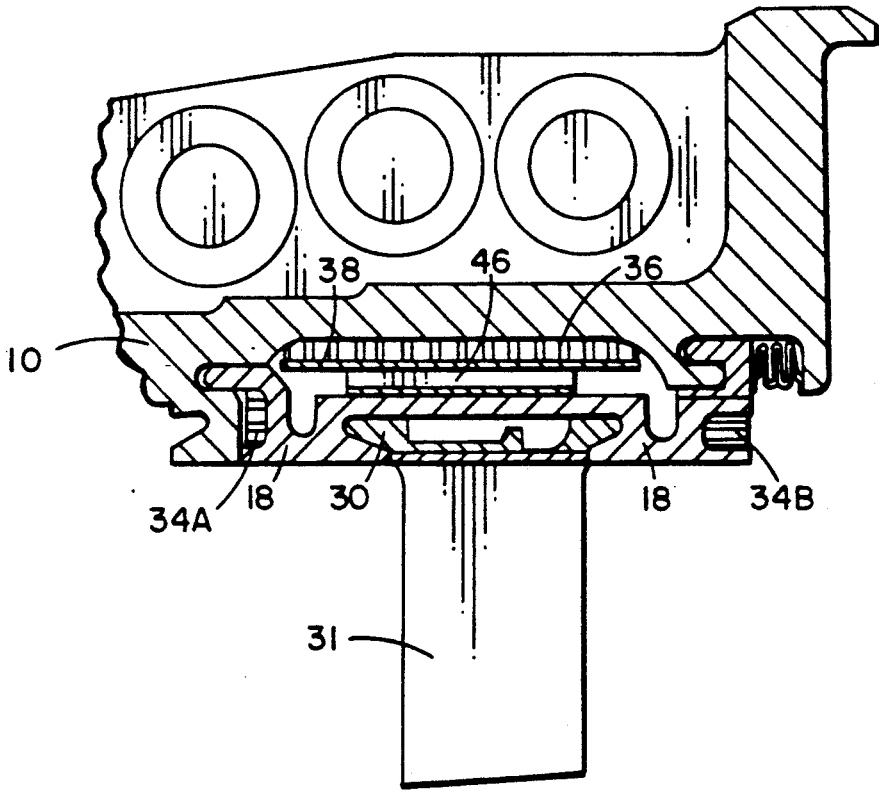
FIG. 7 is a cross-sectional schematic illustration of the present invention with the vane liner depicted therein being located at a different circumferential position than the vane liner depicted in FIG. 1.

In FIG. 7, a side view of a vane liner 18 has a circumferential position indicated by section S—S of FIG. 5. The vane liner 18 is identical in structure to the vane liner located at the twelve o'clock position (line 6B—6B at FIG. 5). However, what is different is that spring 46 pushes the radially aligned plurality of honeycomb cells 36 in contact with case 10 due to the fact that the position of the spring 46 between support plate 38 and vane liner 18 places the spring 46 in compression causing a force to be exerted upon the support plate 38 with the honeycomb cells 36 being pressed against the casing 10.

During engine operation, not all of the honeycomb cells 36 will be placed in contact with the casing 10 due to temperature gradients and thermal expansion of the casing which will result in some cells 36 not quite contacting the casing 10. Ideally, all of the cells will be in contact with casing 10. However, during engine operation some of the cells may not be placed in contact with casing 10 due to manufacturing tolerances or variations. To the extent that there is a gap between the case and the honeycomb, the open cells of the honeycomb present a high drag surface that reduces the velocity of any air flow in the gap, thereby reducing heat transfer to the case 10.

The side mounted axially aligned plurality of honeycomb cells 34A, 34B (FIGS. 2A and 2B) provide vane liners with thermal protection which has heretofore not been available. Plus, the radially aligned honeycomb cells 36 provide the casing 10 with thermal protection which, when combined with the thermal protection afforded by the honeycomb cells 34A and 34B, provide thermal protection for the components located radially outward from the vanes located in a gas turbine engine. The axially aligned honeycomb cells cause a reduction in the tangential and radial velocity of gases directed from the rotation of the rotors. By reducing this tangential and radial velocity of the gases, heat transfer by conduction and convection is reduced.

The foregoing detailed description is intended to be illustrative and non-limiting. Many changes and modifications are possible in light of the above teachings. Although the invention has been described in terms of a compressor vane liner, the invention could also be adapted for use in other flow path liner structures, such as turbine shroud or seal segments, or other segmented flow path segments. Thus, it is understood that the invention may be practiced otherwise than as specifically described herein and still within the scope of the appended claims.

What is claimed is:

1. In a gas turbine engine, a heat shield device comprising:

(a) a vane liner positioned radially outward of a stator vane; and (b) a first plurality of honeycomb cells attached to a first side of said vane liner, wherein each of said first plurality of honeycomb cells includes an axially aligned longitudinal axis.

2. A device according to claim 1 further comprising:

a second plurlaity of honeycomb cells attached to a second side of said vane liner, wherein each of said second plurality of honeycomb cells includes an axially aligned longitudinal axis.

3. A device according to claim 1 wherein said second side is opposite to said first side.

4. A plurality of adjacent vane liners circumferentially positioned in a gas turbine engine, each of said plurality of vane liners having a slot at a forward side of said each vane liner and a slot at an aft side of said each vane liner, the forward side of said each vane liner being substantially flush with an end surface but forming a gap therebetween, and the aft side of said each vane liner being substantially flush with another end surface but forming another gap therebetween, each of said plurality of adjacent vane liners comprising:

a plurality of interconnected honeycomb cells axially aligned and secured to said slot at the forward side of said each vane liner, an open end of each of said plurality of honeycomb cells being substantially flush with the end surface, said plurality of honeycomb cells impeding gas flow between the open end of each honeycomb cell and the end surface.

5. A plurality of vane liners according to claim 4 wherein each of said plurality of adjacent vane liners further comprises:

a plurality of interconnected honeycomb cells axially aligned and secured to said slot at the aft side of said each vane liner, an open end of each honeycomb cell of said plurality of honeycomb cells secured to said slot at the aft side of said each vane liner being flush with the another end surface and impeding gas flow therebetween.

6. A plurality of vane liners according to claim 5 wherein:

said plurality of adjacent vane liners form a forward circumferential slot and an aft circumferential slot.

7. A heat shield system for use in a gas turbine engine comprising:

a vane liner;

a first plurality of honeycomb cells axially aligned and attached to a first side of the vane liner;

a second plurality of honeycomb cells axially aligned and attached to a second side of the vane liner; and a third plurality of honeycomb cells radially aligned and secured to the casing, and wherein the casing is connected to said vane liner.

8. A system according to claim 7 further comprising:

a means for securing said third plurality of honeycomb cells to the casing.

9. A system according to claim 8 wherein:

said means for securing comprises a spring located between said third plurality of honeycomb cells and said vane liner.

10. A system according to claim 9 wherein:

said means for attaching comprises a bolt for attaching a support plate to which said third plurality of honeycomb cells is connected to the casing.

11. A method for reducing convective heat transfer in a member which is adjacent a hot fluid flow path, the member having a slot at a side of the member, the slot having an axial depth which is substantially perpendicular to a direction of flow of the hot fluid, the method comprising the steps of:

(a) filling the slot of the member with a plurality of interconnected tubular honeycomb cells such that the plurality of honeycomb cells have an open end; and (b) aligning the open end of each honeycomb cell of the plurality of honeycomb cells such that a longitudinal axis of each honeycomb cell is axially aligned and substantially perpendicular to the direction of flow of the hot fluid.

* * * * *